US006924075B2

(12) United States Patent
Tavernier et al.

(10) Patent No.: US 6,924,075 B2
(45) Date of Patent: Aug. 2, 2005

(54) DRY TONER COMPOSITION

(75) Inventors: Serge Tavernier, Lint (BE); Werner Op de Beeck, Putte (BE); Sabine Vanhee, Lier (BE)

(73) Assignee: Xeikon International N.V., Lier (BE)

( * ) Notice: Subject to any disclaimer, the term of this patent is extended or adjusted under 35 U.S.C. 154(b) by 0 days.

(21) Appl. No.: 10/371,992

(22) Filed: Feb. 21, 2003

(65) Prior Publication Data

US 2003/0180645 A1 Sep. 25, 2003

Related U.S. Application Data

(60) Provisional application No. 60/359,482, filed on Feb. 22, 2002.

(51) Int. Cl.[7] ..... G03G 9/087

(52) U.S. Cl. ..... 430/109.4; 430/111.4; 430/124

(58) Field of Search ..... 430/108.1, 109.1, 430/109.4, 111.4, 124

(56) References Cited

U.S. PATENT DOCUMENTS

| | | | | | |
|---|---|---|---|---|---|
| 3,853,778 | A | | 12/1974 | Buckley et al. | |
| 4,052,325 | A | | 10/1977 | Santilli | |
| 4,271,249 | A | | 6/1981 | Gilliams et al. | |
| 4,331,755 | A | | 5/1982 | Gilliams et al. | |
| 4,385,107 | A | | 5/1983 | Tanaka et al. | |
| 4,528,257 | A | | 7/1985 | Polderman et al. | |
| 4,600,675 | A | | 7/1986 | Iwasa et al. | |
| 4,940,644 | A | * | 7/1990 | Matsubara et al. | 430/109.4 |
| 5,057,392 | A | * | 10/1991 | McCabe et al. | 430/109.2 |
| 5,346,792 | A | | 9/1994 | Kobayashi et al. | |
| 6,103,781 | A | | 8/2000 | Li et al. | |
| 6,395,442 | B1 | | 5/2002 | Hayashi et al. | |
| 6,716,560 | B2 | * | 4/2004 | Alexandrovich | 430/109.2 |
| 2001/0018157 | A1 | | 8/2001 | Aoki et al. | |
| 2001/0046636 | A1 | * | 11/2001 | Daimon et al. | 430/109.4 |

FOREIGN PATENT DOCUMENTS

| | | | |
|---|---|---|---|
| EP | 307475 | A | 3/1989 |
| EP | 0495475 | B1 | 7/1992 |
| EP | 0495476 | A1 | 7/1992 |
| EP | 0384990 | B1 | 7/1993 |
| EP | 0393252 | B1 | 12/1993 |
| EP | 0384040 | B1 | 1/1994 |
| EP | 0394563 | B1 | 3/1994 |
| EP | 0400706 | B1 | 7/1994 |
| EP | 0716351 | B1 | 6/1996 |
| EP | 1088843 | A3 | 4/2001 |
| EP | 1 126 324 | A | 8/2001 |
| GB | 1373220 | | 11/1974 |
| GB | 1438110 | | 6/1976 |
| JP | 2001 042564 | A | 2/2001 |

OTHER PUBLICATIONS

Database WPI, Sechion Ch., Week 198849, Derwent Publications Ltd., London, GB, AN 1988–348824, XP002242835 & JP 63 258939 A (Nippon Styrene Paper), Oct. 26, 1988, Abstract.

Database WPI, Sechion Ch., Week 199245, Derwent Publications Ltd., London, GB, AN 1992–370570, XP002242836 & JP 04 272937 A (Toray), Sep. 29, 1992, Abstract.

Database WPI, Sechion Ch., Week 198840, Derwent Publications Ltd., London, GB, AN 1988–282685, XP002242837 & JP 63 207823 A (Toray), Aug. 29, 1988, Abstract.

Textbook of Polymer Science; Second Edition; "Polymer Structure and Physical Properties," John Wiley & Sons, Inc., pp. 200–_(1962).

Shirai, et al.; NIP17: International Conference on Digital Printing Technologies; "The Toner for Low Energy Fusing by using Crystalline Polyester." pp. 354–357.

Van Krevelen; Elsevier Publishing Company; "Properties of Polymers—Correlations with Chemical Structure." pp. 386–393.

Van Krevelen; Elsevier Publishing Company; "Properties of Polymers—Correlations with Chemical Structure." pp. 130–133.

Thourson; IEEE Transactions on Electron Devices, Col. ED–19, No. 4, Apr. 1972; "Xerographic Development Processes: A Review."

European Search Report mailed Oct. 10, 2004, for European Application No. 03 44 7036.

* cited by examiner

*Primary Examiner*—John L Goodrow
(74) *Attorney, Agent, or Firm*—Knobbe Martens Olson & Bear LLP

(57) ABSTRACT

The present invention relates to a dry toner composition suited for development of electrostatic charge images, magnetic patterns or DEP (Direct Electrostatic Printing). More specifically the present invention relates to a specific toner composition allowing fusing of the toner image to the final substrate at low temperature.

24 Claims, No Drawings

DRY TONER COMPOSITION

RELATED APPLICATION

This application claims the benefit of U.S. Provisional Application No. 60/359,482, filed Feb. 22, 2002.

FIELD OF THE INVENTION

The present invention relates to a dry toner composition suited for development of electrostatic charge images, magnetic patterns, or DEP (Direct Electrostatic Printing). More specifically the present invention relates to a specific toner composition allowing fusing of the toner image to the final substrate at low temperature.

BACKGROUND OF THE INVENTION

It is well known in the art of electrographic printing and electrophotographic copying to form an electrostatic latent image corresponding to either the original to be copied, or corresponding to digitized data describing an electronically available image.

In electrophotography, an electrostatic latent image is formed by uniformly charging a photoconductive member and image-wise discharging it by an image-wise modulated photo-exposure.

In electrography, an electrostatic latent image is formed by image-wise deposition of electrically charged particles, e.g., from electron beam or ionized gas (plasma), onto a dielectric substrate.

The latent images thus obtained are developed, i.e., converted into visible images by selectively depositing thereon light absorbing particles, referred to as toner particles, which are typically electrically charged.

In magnetography, a latent magnetic image is formed in a magnetizable substrate by a pattern-wise modulated magnetic field. The magnetizable substrate must accept and hold the magnetic field pattern required for toner development, which proceeds with magnetically attractable toner particles.

In toner development of latent electrostatic images two techniques have been applied: "dry" powder development and "liquid" dispersion development. Dry powder development is nowadays most frequently used.

In dry development, the application of dry toner powder to the substrate carrying the latent electrostatic image or magnetic image may be carried out by different methods, including "cascade", "magnetic brush", "powder cloud", "impression," and "transfer" or "touchdown" development methods. See, e.g., Thomas L. Thourson, IEEE Transactions on Electronic Devices, Vol. ED-19, No. 4, April 1972, pp.495–511.

In liquid development, the toner particles are suspended in an insulative liquid, both constituents forming together the so-called liquid developer. During the development step, the toner particles are deposited image-wise on the latent electrostatic image-bearing carrier or magnetic image-bearing carrier by electrophoresis (under the influence of electrical fields) or magnetophoresis (under the influence of magnetic fields). In these particular development steps, the toner particles have, respectively, an electrical charge or a magnetization.

Whereas liquid toner systems have been commonly employed in the past due to their high performance in terms of resolution and image quality, dry toner systems are currently more popular, as they are capable of achieving similar image quality while offering at the same time the advantage that no solvent emission is involved. Liquid toner compositions and methods of using same are disclosed in copending U.S. application Ser. No. 10/372,645, filed on even date herewith and entitled "LIQUID TONER COMPOSITION."

The visible image of electrostatically or magnetically attracted toner particles is not permanent and has to be fixed. Fixing is accomplished by causing the toner particles to adhere to the final substrate by softening or fusing them, followed by cooling. Typically, fixing is conducted on essentially porous paper by causing or forcing the softened or fused toner mass to penetrate into the surface irregularities of the paper.

Dry development toners typically comprise a thermoplastic binder including a thermoplastic resin or mixture of resins (see, e.g., U.S. Pat. No. 4,271,249) and coloring matter, e.g., carbon black or finely dispersed pigments. The major challenge with respect to dry toning systems is related to the fusing process. The preference for higher process speeds and for a broad spectrum of final substrates, as well preferences for various thicknesses, pose additional stress on the fusing process. Apart from these considerations, there is also the tendency to prefer smaller particles and thinner toner layers. Whereas it could be expected that thinner toner layers are more easily fused, it is observed in reality that this leads to more pronounced fusing problems. The reason is that higher concentrations of pigments are needed in thin toner layers in order to reach the target optical density. These higher concentrations induce a higher melt viscosity, which results in a marked decrease in fusing performance of such toner particles.

There are different types of processes used for fusing a toner powder image to its final substrate. Some are based primarily on fusing by heat, others are based on softening by solvent vapors, and others by the application of cold flow at high pressure under ambient temperature conditions.

In fusing processes based on heat, two major types of processes are typically employed: "non-contact" fusing processes and "contact" fusing processes. In non-contact fusing processes there is no direct contact of the toner image with a solid heating body. Such processes include, for example: an oven heating process in which heat is applied to the toner image by hot air over a wide portion of the support sheet; and a radiant heating process in which heat is supplied by a light source, e.g., an infrared lamp or flash lamp, which emits infrared and/or visible light that is absorbed by the toner. In such "radiant" non-contact fusing processes, radiation (such as infrared radiation) may be at least partly absorbed by the final support and therefrom transferred by conduction to the toner image(s) deposited thereon.

Non-contact fusing has the advantage that the non-fixed toner image does not undergo any mechanical distortion. The fine image details do not suffer distortion from transfer to a contacting fixing member, the so-called "offset" phenomena typically observed for hot pressure roller fusing. Non-contact fusing, however, has the major disadvantage that in the case of a process malfunction the final substrate or support can remain in the hot fusing zone for an undesirably long time, such that the substrate heats up to ignition temperature, thereby causing a fire hazard. This is especially a risk in the case of cut sheet-based engines. Special, costly measures have to be taken to avoid this major danger. Aside from this disadvantage, there is some difference between colors in fusing quality and image quality of the fused image, as the spectral absorption coefficients are not equal over all colors present in the print.

An alternative to "non-contact" fusing that is commonly employed is the so-called "contact" fusing process. In contact fusing, the support carrying the non-fixed toner image is conveyed through the nip formed by a heating roller (also referred to as a fuser roller) and another roller backing the support and functioning as a pressure-exerting roller (also referred to as a pressure roller). This roller may be heated to some extent so as to avoid strong loss of heat within the copying cycle. Other variations on the contact fusing process include use of a fuser belt combined with a pressure roller, or a combination of a fuser belt and a pressure belt.

SUMMARY OF THE INVENTION

A dry toner wherein the composition of the toner particles is such that the toner particles fix at low temperature is desirable. Also desirable is a dry toner that allows fixing at high process speed, and which is suited for making color images which can be fixed at high process speed. A toner suited for making color images with good mechanical stability, showing no rubbing sensitivity nor smear of the final image, is also desirable, as is a toner suited for making color images with no tendency to show mutual tack upon storage at elevated ambient temperatures, and which exhibits good image quality and good color characteristics, and increased color strength suited for making color images with thin toner layers. It is also desirable to provide such a toner using simple binding resin materials and which can be produced using simple toner production processes.

In accordance with the preferred embodiments a dry toner is provided, the particles of which are electrostatically or magnetically attractable and suitable for use in the development of electrostatic charge images or magnetic patterns. The toner particles comprise a colorant and a binder resin, the binder resin comprising an amorphous polymer, or a mixture of an amorphous polymer and a linear crystalline phase-containing polymer, or a mixture of linear crystalline-phase containing polymers. The amorphous polymer or mixture of amorphous polymers preferably has a Tg>40° C. and the crystalline phase containing polymer or mixture of crystalline phase-containing polymers preferably has a melt energy larger than 35 J/g. Both the crystalline and the amorphous polymers exhibit a compatibility in the molten state and show no or no significant phase separation upon cooling. It is preferred that the toner comprise from about 1:2 to 9:1 amorphous polymer to crystalline. phase-containing polymer.

In preferred embodiments, the amorphous polymer or polymer mixture has a softening point at most 10° C. lower, but preferably equal to or even more preferably 10 to 20° C. higher than the melting point of the crystalline phase-containing polymer or polymer mixture.

In accordance with the preferred embodiments there are also considered methods for fixing unfixed toner images on a recording medium comprising processes such as non-contact fusing methods (oven fusing, radiation fusing, and the like) and contact fusing methods (hot roller fusing, transfusing).

In a first embodiment, a dry toner composition is provided, the composition including a colorant; and a binder resin, the binder resin including an amorphous polymer and a crystalline phase-containing polymer, wherein the amorphous polymer and the crystalline phase-containing polymer are compatible in a molten state mixture and show no or no significant mutual phase separation upon cooling of the molten state mixture, wherein the crystalline phase-containing polymer has a melt energy greater than or equal to about 35 J/g, and wherein the amorphous polymer has a Tg greater than or equal to about 35° C.

In an aspect of the first embodiment, the dry toner composition comprises from about 3 wt. % to about 75 wt. % of the crystalline phase-containing polymer.

In an aspect of the first embodiment, the dry toner composition comprises from about 8 wt. % to about 55 wt. % of the crystalline phase-containing polymer.

In an aspect of the first embodiment, a melting point of the crystalline-phase containing polymer is greater than or equal to about 50° C.

In an aspect of the first embodiment, a melting point of the crystalline-phase containing polymer is greater than or equal to about 65° C.

In an aspect of the first embodiment, the Tg of the amorphous polymer is greater than or equal to 40° C.

In an aspect of the first embodiment, a softening temperature of the binding resin is greater than or equal to 100° C.

In an aspect of the first embodiment, the crystalline phase-containing polymer includes a polyester.

In aspects of the first embodiment, the amorphous polymer includes a polyester, or a mixture of a polyester and a non-polyester.

In aspects of the first embodiment, the colorant includes an inorganic pigment or an organic colorant.

In an aspect of the first embodiment, the dry toner composition further includes a colloidal inorganic filler.

In an aspect of the first embodiment, the dry toner composition further includes a charge control agent.

In an aspect of the first embodiment, the dry toner composition further includes spacing particles.

In an aspect of the first embodiment, the dry toner composition further includes a conductivity regulating agent.

In an aspect of the first embodiment, the dry toner composition further includes a metal soap.

In an aspect of the first embodiment, the toner composition includes particles, wherein a particle size of the particles is from about 3 $\mu$m to about 20 $\mu$m in diameter. The particles can be rounded.

In a second embodiment, a developer composition is provided, the composition including carrier particles; and a dry toner composition, the dry toner composition including a colorant; and a binder resin, the binder resin including an amorphous polymer and a crystalline phase-containing polymer, wherein the amorphous polymer and the crystalline phase-containing polymer are compatible in a molten state mixture and show no or no significant mutual phase separation upon cooling of the molten state mixture, wherein the crystalline phase-containing polymer has a melt energy greater than or equal to about 35 J/g, and wherein the amorphous polymer has a Tg greater than or equal to about 35° C.

In an aspect of the second embodiment, a particle size of the carrier particles is from about 30 $\mu$m to about 100 $\mu$m in diameter.

In a third embodiment, a method for fusing a dry toner powder to a substrate is provided, the method including applying a dry toner powder to a substrate, the dry toner powder including a colorant and a binder resin, the binder resin including an amorphous polymer and a crystalline phase-containing polymer, wherein the amorphous polymer and the crystalline phase-containing polymer are compatible in a molten state mixture and show no or no significant phase separation upon cooling of the molten state mixture, wherein the crystalline phase-containing polymer has a melt energy greater than or equal to about 35 J/g, and wherein the amorphous polymer has a Tg greater than or equal to about 35° C.; and applying heat to the dry toner powder, whereby the dry toner powder is fused to the substrate, thereby forming an image.

In an aspect of the third embodiment, the image includes a color image.

In an aspect of the third embodiment, the step of applying heat to the dry toner powder is conducted at a fusing speed greater than or equal to about 10 cm/sec.

In an aspect of the third embodiment, the method further includes the step of applying mechanical pressure to the dry toner powder, wherein the step of applying mechanical pressure to the dry toner powder is conducted simultaneously with the step of applying heat to the dry toner powder.

In an aspect of the third embodiment, the step of applying heat to the dry toner powder is contactless.

In a fourth embodiment, a dry toner composition is provided, the composition including a colorant and a binder resin, the binder resin including a polymer composition, wherein the polymer composition has a crystallinity of greater than about 30 wt. %, wherein the polymer composition has a melt energy greater than or equal to about 10 J/g, preferably greater than 30 J/g and more preferably greater than 40 J/g and wherein the polymer composition has a Tg greater than or equal to about 35° C. It may be advantageous to limit the overall crystallinity of the polymer composition, e.g. to less than 100 J/g or less than 80 J/g.

DETAILED DESCRIPTION OF THE PREFERRED EMBODIMENT

The following description and examples illustrate a preferred embodiment of the present invention in detail. Those of skill in the art will recognize that there are numerous variations and modifications of this invention that are encompassed by its scope. Accordingly, the description of a preferred embodiment should not be deemed to limit the scope of the present invention.

In a dry toner, it is preferred that the fusing degree of the toner is good, thus suggesting the use of resins exhibiting low melt viscosity at the fusing temperature. Whereas in the case of black and white images this has been achieved to an appreciable degree, this is not the case for color images. In the case of color images, not only a single toner layer, but also higher toner piles are present. In order to fuse such images a low viscosity is preferred. Also, the fixing degree of the copy is of concern to avoid image crack when the image is folded. Whereas an acceptable solution has been achieved for black and white images, even at higher process speed, this has not been achieved for color images. This holds especially true for high process speeds, which are becoming of greater interest as color printing moves to the high volume market and process speeds of 25 cm/s up to 100 cm/s are desired.

In order to meet the demand for high process speed and/or toners with higher pigment loading, a higher operational fusing temperature can be set at the fusing unit. There is, however, a limit to the fusing temperature as the stability of the coatings on the fusing members imposes an upper operational temperature in order to avoid degradation. The melt viscosity of the toner can also be lowered. Also, the softening temperature of the binding resin can be lowered, the softening temperature being a first indication of the temperature at which melt flow is observed. However, by lowering the softening temperature of the binding resin, the glass to rubber transition, the so-called 'Tg' of the binding resin is also lowered. As the Tg falls below 40 to 45° C., serious blocking of the resin as well as blocking/agglomeration of the constituent toner particles is observed, giving rise to impaired image quality. Also, it is found that printed sheets show mutual tack even at temperatures in the range of 35 to 40° C. upon storage for some time under load, e.g., in a stack of printed images. A careful tuning of softening temperature, glass rubber transition temperature as well of melt viscosity can only partially solve the problem of fusing of toner based color images at higher process speed.

Specific toner and binding resin compositions have been developed that yield the best possible fusing of color images at low to intermediate process speed. Basically, two different approaches are employed. The first makes use of amorphous polymeric binding resins. The second makes use of crystalline materials.

Within the field of amorphous polymers, useful systems are described by a typical 'Tg' set at 50° C. or higher, more preferably 55° C. or higher, imposing a softening temperature of 100° C. or higher. Specific designs of the binding resin are proposed so that a low melt viscosity is achieved. It is generally appreciated that polyester based resins offer a somewhat better balance between Tg, softening temperature, and melt viscosity than other resin materials, such as styrene acrylic or styrene (meth)acrylic systems. However, hybrid systems, containing both polyester and non-polyester moieties, such as styrene (meth)acrylic moieties, are also suitable. Within the polyesters, other resin compositions have been described, such as in U.S. Pat. No. 5,346,792, wherein specific unusual soft monomers are incorporated in the resin. Some approaches are based on the blending of two or more polyester resins. For example, in EP-0495475 there is described a blend of two linear polyesters with very specific softening properties, both tuned with respect to each other. The design of a specific softening behavior implies a specific design of molecular weight distribution, especially in the case of linear polyesters. In EP-0495476 there is described a blend of a linear and a non-linear polyester. Tri-blends are also described, e.g. in EP-0716351. In this latter patent a specific composition is also described, characterized in that long alkyl chains are present in the resin. Whereas the use of uncommon monomers will increase cost, the same holds true for very specific molecular weight distributions and/or softening points, as rather narrow specifications for the material will be set forth.

Within the field of crystalline materials, only a limited number of teachings can be found in the prior art regarding binding resins. The use of crystallite-containing polyolefin-based and/or natural waxes as a binding resin is known in the art, especially for cold 'contact' fusing. The sharp melting properties and also the typical range for the melting point, i.e., 85 to 150° C., make then interesting as binding resins for low temperature fusing toner particles. However, they have the disadvantage that they are waxy and easily smeared out, impeding the production of mechanically stable images, and exhibit rather matte waxy-looking images. Other teachings, e.g., U.S. Pat. No. 4,528,257 and U.S. Pat. No. 4,940,644, suggest that the use of specific block copolymers and/or graft-copolymers containing crystalline segments can be advantageous in designing lower temperature fusing toners. In a similar way, it is reported in U.S. Pat. No. 3,853,778 that the use of polymers containing crystallizable units pendant to the backbone can induce improved fusing characteristics. Also, the use of a specific chemical reaction of polymers and/or polymer-precursors during the preparation of the toner particles giving rise to crystallizable sub elements has been described. It is, however, clear from these teachings that the (pre-)polymers are highly complex, expensive, and/or complex in their preparation and use, so that the practical use is greatly limited. Recently, Shirai et al. published, in the NIP17-Proceedings 2001, p. 354, a discussion of the use of crystalline materials in blend with amorphous materials. The publication indicates progress by the use of such blends, and potentially offers the advantage that more simple basic materials can be used. The process exploits incompatibility between both the crystalline and amorphous materials, to yield particles up to the order of several microns. This approach is in contrast with the general preference for smaller toner particles, as a particle identity problem will arise due to the dispersed state of the resin matrix, which is reported to be in the range of several μm in size. U.S. patent application No. 2001/0018157-A1 includes similar teachings and claims specific compositions for the crystalline and amorphous polymer in order to achieve this state. EP-1088843 by KAO teaches the use of only crosslinked crystalline polymers. Whereas in this situation the problem regarding dispersion is not present, the presence of branching impedes high crystallinity, which induces the presence of an appreciable amount of amorphous, low Tg material. This low Tg will negatively impact lifetime-related properties for the toner and corresponding developers. The concern that Tg for the amorphous part of such crystalline resins is low is dealt with in detail in the literature, e.g. by Van Krevelen, "Properties of Polymers," Elsevier Publishing Company, 1972, p.130.

Accordingly, no general solution exists in the literature to the problems involved in the fusing of toner-based color images at high process speed.

Surprisingly, it has been found that it is possible to design a toner composition using simple, commonly available resin materials exhibiting appreciable latitude with respect to low viscosity melt behavior and composition, the toner composition allowing the creation of high quality color prints in terms of image gloss, fixing degree, and mechanical stability of the fused image. It has moreover been found that this particular toner composition is well suited for fixing color images at a high fusing speed, e.g., 10 cm/sec and higher. It has moreover been found that this particular toner composition gives no interprint tack even after storage in a pile and at elevated ambient conditions. It has been found that by using this toner composition it is possible to design a fixing process allowing fusing at the above-mentioned speed and allowing the achievement of high quality color images. It has been found that it is possible to incorporate higher concentrations of coloring material in such toners, allowing color imaging with thinner toner layers. It has been found that by using this toner composition it is possible to design a transfixing process allowing transfixing at the above-mentioned speed and allowing the achievement of high quality color images. The different aspects of the preferred embodiments will be described in more detail hereinafter.

The specific toner compositions of preferred embodiments are characterized by the fact that the resin binder contains an amorphous part and a part containing crystallites, wherein both parts have some compatibility. It has been found, surprisingly, that neither a specific monomer composition, nor a specific molecular weight distribution design, nor a specific combination of both aspects are needed to achieve the specific fixing performance. It has been found that it is preferred to use amorphous resins and crystallites-containing resins which belong to the same category of resins, in order to achieve compatibility. It is not impossible to combine different families of resins that also show compatibility, but choosing them from the same family is preferred. It has been found, for example, that by using a combination of an amorphous polyester with some specific thermal-mechanical properties, in combination with a partially-crystalline polyester containing a sufficient amount of crystalline content, that both resins have some degree of compatibility, as expressed by the fact that the polymers are compatible at high temperature and that they show no significant phase separation upon cooling. Compatibility (or degree of phase separation) may be determined as described below. By using the combination of polymers in some specific weight ratio, an excellent fixing performance can be obtained, with good image quality, and good mechanical and tack properties.

The polymers described above as "crystalline" include those which possess some degree of amorphousness, but which retain overall their substantially crystalline character. It is generally preferred that the crystallinity of the polymer is greater than about 30 wt. %, more preferably greater than about 50 wt. %, as determined by Differential Scanning Calorimetry (DSC).

The polymers described above as "amorphous" include those which possess some degree of crystallinity, but which retain an overall substantially amorphous character. It is generally preferred that the crystallinity of the amorphous polymer is less than about 25 wt. %, more preferably less than about 15 wt. %, e.g., as determined by DSC.

Suitable binder resins according to the preferred embodiments may be prepared by blending or mixing two or more polymers with suitable "amorphous" and/or "crystalline" character. Alternatively, the binder resins of preferred embodiments may include, e.g., a single polymeric material exhibiting both an "amorphous" phase and a "crystalline" phase.

It has been found, surprisingly, that both the presence of the amorphous and the crystallite containing part is essential to preparing satisfactory toners, as is the intrinsic degree of compatibility, and the degree of crystallinity. It has been found that pure crystalline containing resins do not give the targeted properties, nor do pure amorphous polymers or polymer mixtures. Whereas some melt viscosity range is needed in order to generally meet the requirement of the fixing degree of the copy, it was found that this range can be rather broad, as long as the requirements put forward herein are met.

The mechanical behavior of the amorphous polymeric part, as expressed by the Tg value of the polymer or the polymer mixture, is preferably from about 35° C. to 80° C., more preferably 45–65° C. Lower Tg will give mutual tack of the final images, whereas a higher Tg-value will correspond to a melt or softening point that is too high, corresponding in its turn to a fusing temperature that is too high. The melt behavior of the amorphous part should be chosen in regard to the characteristics of the fusing fixture. The softening temperature of the amorphous polymer or polymer mixture is preferably from about 80 to 150° C., more preferably 85 to 130° C.

In situations where a very low fusing or transfusing temperature is preferred it is desirable to choose the softening temperature in the range of 85 to 120° C. Linear or partially crosslinked polymers can be used, as well as blends of linear and partially crosslinked resins. Some degree of crosslinking in the polymer has been found to give desirable visco-elastic properties, reducing the so-called hot offset phenomena often encountered in hot roller fusing.

The properties of the crystalline phase-containing polymer are expressed by its melting point, as well as by its crystalline behavior. Preferably, the melting point is chosen to be a low temperature, as fusing at high speed and low fixing temperature is preferred. In this respect, a melting point lower than 175° C., a typical fixing temperature of hot roller fusing systems, is an obvious upper limit. More preferably, the melting point is lower than 130° C., and preferably even lower than 110° C. On the other hand, the melting temperature should be high enough so that at even more elevated temperatures during storing, no fundamental changes in the toner material occur. This means a melting temperature higher than 50° C., more preferably higher than 65° C. A particularly preferred region for melting temperature will lay between 65 and 110° C. The degree of crystallinity and crystallization energy is of concern, as it expresses the tendency and degree of perfection of crystallization.

In the toner compositions of preferred embodiments, the amorphous polymer is an essential constituent of the binder composition, and high crystallization tendency is preferred, suggesting high crystalline content in the crystalline phase-containing polymer. Apart from the degree of crystallinity, the tendency to crystallize also plays a role in performance of the toner composition. The lower the intrinsic crystallization energy, the lower the tendency to build up the crystalline phase, and the slower the crystallization process occurs. A slow process may result in problems as the fused images will have a "tack" persisting for some time after the fusing process. A value which reflects both the amount of crystallinity as well as the crystallization energy is the melt-energy of the crystalline polymer or mixture of the crystalline polymers.

Apart from these considerations, it is found that especially linear to only slightly branched crystalline polymers are effective. The reasons probably lie in the fact that branching and/or cross-linking impedes efficient ordering in the system and hence will lead to loss in crystallinity.

Crystalline materials with high crystallization behavior are preferred for use in blends with amorphous polymers. The presence of the amorphous polymer will by itself reduce the crystallization behavior of the crystalline material drastically, so that the crystalline material will appear in its amorphous state, which is characterized by a very low Tg value. As a general rule, Tg of the amorphous state of crystalline materials lies at ⅔ of the melting temperature, as described, for example, by Van Krevelen, "Properties of Polymers", Elsevier Publishing Company, 1972, p.130.

As the preferred melting temperature is around 130° C. or lower, the corresponding Tg will be about the same temperature or up to about 10° C. lower. It is inevitable that the presence of a substantial quantity of amorphous polymer will increase drastically the tackiness of the toner particles, impeding any practical use. This behavior of the amorphous polymer or polymer mixture is absent when no compatibility between the crystalline and the amorphous polymers is observed. However, a situation with no compatibility would lead to phase separation and toner particles showing no distinct identity, and thus exhibiting poor performance.

It was therefore surprisingly found that it is possible to employ specific combinations of crystalline and amorphous materials showing both a good compatibility and hence no toner design problem from the viewpoint of identity of particles, and a good crystalline content of the final blend, showing no Tg and tack problems. In such particles, the melting of the crystalline moieties within the toner particles allows for a drastic reduction in melt viscosity, resulting in preferred low temperature fusing properties, and at the same time allowing quick crystallization of the fused image, resulting in mechanical stability and "no-tack" properties.

From experimental work it was found that the crystalline polymer or polymer mixture preferably has a melt energy of at least 35 J/g, as measured by DSC-method, as described below. A value lower than 35 J/g reflects a tendency for crystallization too low in situations where compatible melt blending with amorphous polymers is conducted. The crystalline material is preferably linear or at maximum slightly branched. Whereas there is no specific region in terms of molecular weight of the crystalline polymer, it is found that there is a benefit to using lower molecular weight materials, for two reasons: (1) high molecular weight material will give higher viscosity and hence slower crystallization behavior and thus reduction in crystallinity; and (2) low molecular weight material will show a larger entropy term upon mixing with the amorphous material and hence result in more latitude towards compatibility of the resins.

With respect to mutual compatibility, it is essential that there is, in molten state, good compatibility as the low viscosity of the molten material will be able to induce a further viscosity drop in the total resinous matrix of the toner particle. It is also preferred that upon cooling a fair degree of compatibility persists, so that the only separated regions are the crystallites which form. This will result in a very intimate mixture of the resins, resulting in a good identity of the toner particles made up from such a blend. Also, the intimate mixture will induce very efficient melt viscosity drop upon melting of the crystallites present. From these considerations, it is expected that it is beneficial that the melting point of the crystallites is at most 10° C. higher than the typical softening temperature of the amorphous phase. It is considered preferable that the melting point is lower than the softening temperature of the amorphous phase, and even more preferably 10 to 20° C. lower than this softening temperature.

It is apparent that the exact chemical composition of the amorphous and crystalline material will also have some effect on their mutual compatibility, as this will be reflected in the enthalpy term of the mixing process. In this sense it is possible to use parameters such as the Hildebrand solubility parameter, to select preferred combinations of amorphous and crystalline polymers. From this consideration, it is clear that, for example, the combination of an amorphous polyester with a polyolefin-type crystalline material will not fulfill the conditions of the preferred embodiments. Distinct phase separation occurs upon melt mixing due to the intermediate polar properties of the polyester and the apolar or nonpolar properties of the polyolefin. The resulting toner composition will be a distinctly non-uniform system with areas of amorphous material and areas with crystalline material, showing poor adhesion between both areas. Upon mechanical impact (as well during preparation and during use) the composition will fall apart. It is possible to conduct a very simple test to select a preferred compatibility as will described below, such a test permitting the selection of materials even when no chemical structure or Hildebrand parameter is known.

With respect to the definition of linear or only slightly branched, as used herein, it is understood that a resin containing at most an additional 1%, expressed in molar ratio, of a tri- or higher valent monomer in its composition is considered to be linear. In the case of polyesters, which are employed in preferred embodiments, an acidic crosslinker can be selected, e.g., from the group of aromatic poly-acids with valence higher than two, such as, e.g., trimellitic acid. In the case of an alcohol-based cross linker being used, it can be selected, e.g., from the group of 2-ethyl-2-hydroymethyl-1,3-propanediol, tetrakishydroxymethy-methane, glycerol, and the like. Whereas for the amorphous resin there is no special limitation as to linearity or no linearity, there is for the crystalline polymer or polymer mixture.

Amorphous polymer resin compositions suited for the present invention can have a variety of compositions, as the specific composition itself is not believed to be essential in the toners of preferred embodiments. Preferred polymers are found in the family of polyesters as well as in the family of the so called hybrid resins, i.e., types of resins comprising polyester as well as non-polyester, e.g., styrene/acrylic or styrene/methacrylic, constituents. A polyester resin suitable for use in toner particles according to the present invention can be selected, e.g., from the group of polycondensation products of (i) di-functional organic acids, e.g., maleic acid, fumaric acid, succinic acid, adipic acid, terephthalic acid, isophthalic acid, and (ii) di-functional alcohols (diols) such as ethylene glycol, triethylene glycol, aromatic dihydroxy compounds, preferably bisphenols such as 2,2-bis(4-hydroxyphenyl)-propane called bisphenol A, or an alkoxylated bisphenol, e.g., propoxylated bisphenol A, examples of which are given in U.S. Pat. No. 4,331,755. For the preparation of such resins, reference is made to GB-1373220. A non-linear resin suitable for use in toner particles according to the preferred embodiments can be selected, e.g., from resins obtained from similar compositions as mentioned for the linear polyester resins but containing additionally at least 1%, expressed in molar ratio, of a tri- or higher valent monomer. When an acidic crosslinker is used, it can be selected, e.g., from the group of aromatic poly-acids with valence higher than two, such as e.g. trimellitic acid. When an alcohol-based cross linker is used, it can be selected, e.g., from 2-ethyl-2-hydroxymethyl-1,3-propanediol, tetrakis-hydroxymethylmethane, glycerol, and the like.

Examples of particularly useful polyester resins are listed in the Table 1, along with melt viscosity at 120° C., composition, and type of polyester. Compositions can be read as follows: EBA is ethoxylated bisphenol A; PBA is propoxylated bisphenol A; IA is isophthalic acid; TA is terephthalic acid; EG is ethylene glycol; AA is adipic acid; and FA is fumaric acid. AP refers to an amorphous polymer.

TABLE 1

| Resin | Viscosity (120° C.) Pa · s | Tg (° C.) | Softening temperature (° C.) | alcohols | acids |
|---|---|---|---|---|---|
| AP1 | 80 | 54 | 101 | PBA(100) | TA/AA(75/25 |
| AP2 | 175 | 51 | 104 | PBA(100) | FA(100) |
| AP3 | 400 | 58 | 112 | EBA/ EG(80/20) | IA/TA(40/60) |

Crystallite containing polymer resin compositions suited for the preferred embodiments can have a variety of compositions, as the composition itself is not believed to be essential. Pure aliphatic as well as aromatic group-containing polymers can be employed. Regarding polyester based materials, reference is made to EP-0146980, describing inter alia, aliphatic crystallite-containing resins composed of long chain diols and/or long chain diacids. According to the previous discussion, it is, however, preferred that the melting temperature is higher than 50° C., preferable higher 65° C., but lower than 110° C. An interesting discussion regarding crystalline polyesters is given in "Textbook of polymer science", by Billmeyer, Wiley-Interscience 1971, p 220 and following pages, showing inter alia the change in melting point of such materials, specifically linear polyesters containing a long chain di-alcohol (decamethyleneglycol) in combination with aliphatic saturated di-acids ranging from short (1) to long (10) interacid methylene groups. Likewise, combinations of a short di-alcohol, e.g. glycol, with long chain di-acids can be employed, as shown in the same reference. Use of an interacid group chain of at least 8 carbon atoms, preferably at least 10 carbon atoms, is preferred in order to have melting temperatures higher than 65° C. As well, combined long chain systems such as poly(decamethylene dodecanoate) can be employed. Additional data on crystalline polymers can be found in Van Krevelen, "Properties of Polymers," Elsevier Publishing Company, 1972, Appendix 2. Apart from pure linear crystalline polyesters, other materials can be employed. A preferred crystallite-containing polymer is polycaprolactone. Also, aromatic moiety-containing polymers can be used, as described in U.S. Pat. No. 5,057,392, describing inter alia polymers containing hexane-diol and butane-diol as diol components, and terephthalic acid and isophthalic acid is di-acids. Typical melting points (Mp) range from 90 to 100° C. Table 2 describes some non-limiting examples of polyester-based crystalline materials investigated. Also is mentioned a PE-wax. The melt-energy is also given as M-E.

TABLE 2

| resin | Mp (° C.) | M-E (J/g) | type |
|---|---|---|---|
| CP1 | 85 | 100 | Linear |
| CP2 | 103 | 42 | Linear |
| CP3 | 49 | 54 | Linear |
| CP4 | 115 | 44 | Non-linear |
| CP5 | 105 | 240 | Linear (PE-wax) |

Test Methods

Test for Determination of Softening Point

The softening temperature is measured with a CFT500 apparatus sold by Shimadzu. A sample of 1.1 g of the material is put in the preheated apparatus at 80° C., the apparatus being equipped with a die with a bore 1 mm in diameter and 10 mm in length. The sample is thermally equilibrated for 7 minutes. Then the temperature is raised at a rate of 3° C./min and the material is subjected to a load of 10 kg. The outflow of the material is monitored.

The softening temperature is determined as that temperature where 50% of the sample has flowed out.

Test for the Determination of Tg

Tg is determined according to ASTM D3418-82.

Test for the Determination of Viscosity of Resin

For determining the melt viscosity of the selected sample a Carrimed CSL500 is used. The viscosity measurement is carried out at a sample temperature of 120° C. A sample having a weight of 0.75 g is applied in the measuring gap (about 1.5 mm) between two parallel plates of 20 mm diameter one of which is oscillating about its vertical axis at 100 rad/sec and with an amplitude of $5\times10^{-3}$ radians. Before recording the measurements, the sample is allowed to attain thermal equilibrium for 10 minutes. The viscosity is expressed in Pa·s.

Test for the Determination of Crystallization Energy and Melting Point

Melting properties are measured by DSC type equipment, Seiko DSC220C. Approximately 10 mg of material to be investigated is put into the measuring cup and an empty pan is used as reference. Heating rate and cooling rate (liquid nitrogen) is set at 20° C./min. The sample is measured in a first run after cooling the sample to −50° C. and then heating to 150° C. The melting temperature is taken at the maximum of the endothermic peak corresponding to the melting process. The melting energy (crystallization energy) is read from the chart as the area between the curve and the baseline corresponding to the position around the melting curve. The melting energy is expressed in J/g.

Test for Determination of Compatibility

A simple miscibility test can be used. The materials under investigation (1:1 ratio w/w) are melted and mixed mechanically at a temperature of 150° C. The equilibration time is 5 minutes. The mixture is observed in terms of milkiness and/or phase separation at this temperature. Pronounced milkiness and/or phase separation is indicative of insufficient compatibility. Satisfactory compatibility (i.e., no substantial phase separation) is indicated by a transparent or only slightly hazy mixture. Results of compatibility tests of polymer combinations are reported in Table 3. AP refers to an amorphous polymer and CP refers to a crystalline polymer.

TABLE 3

| | | |
|---|---|---|
| AP1 | CP1 | Transparent |
| AP1 | CP2 | Transparent |
| AP1 | CP3 | Very milky/haze |
| AP1 | CP4 | Very milky/haze |
| AP1 | CP5 | Phase separation |
| AP2 | CP4 | Slight haze |
| AP2 | CP1 | Transparent |
| AP3 | CP1 | Phase separation |
| AP3 | CP4 | Phase separation |

Determination of Fixing Properties

Contact-Fusing by Hot Roller Fixing Process

A symmetrical fixing unit is used containing two identical fuser rollers, including an upper roller and lower roller. The outer diameter of the rollers is 73 mm. Both rollers are silicone rubber based, have a hardness of 50 ShoreA, and have a thickness of the rubber coating of 3 mm. Thermal conductivity is set at 0.4 W/mK. Electrical conductivity is set at medium level in order to avoid paper jams due to electrification. A nip of 9–10 mm is formed. Both rollers are oiled at a rate corresponding to low oil deposition on the fixed print. The oil deposition is defined as the amount of oil deposited on a single side of a A4 size paper upon the fixing process in a multiple print mode and is expressed in mg/A4. The oil deposition is preferably 10–15 mg/A4. Different fixing speeds are studied ranging from 10 to 20 cm/s. The temperature of the fixing device typically is set in the range of 80–180° C. A single sided coated 100 g/m$^2$ paper is used. Toner depositions of 2.0 mg/cm$^2$ were fixed, corresponding to a quadruple toner layer.

Non-Contact Fusing

Non-contact fusing was done in an isothermal fashion, using an oven. The images were fixed for 5 minutes at different temperatures in the range of 80–130° C.

Folding Test (F-Test)

After the toner image is fused at the set temperature, the cold image is folded image inside. The image is unfolded and the fold rubbed for 5 times by hand. The decrease in image density is visual inspected before and after folding.

Tack Test

A tack test is performed by putting a weight of 50 g/cm$^2$ for 15 min at a temperature of 60° C. on a folded fused toner image (image inside) with a toner coverage of 2 mg/cm$^2$. After 15 min the sample is cooled down and unfolded. Evaluation was done on samples with F-test ranking 1.

Gloss Test

Gloss testing was conducted by visual inspection.

Wax Look&Feel Test (WLF-Test)

WLF-test was conducted by visual inspection. Evaluation was done on samples with F-test ranking 1.

Toner Preparation

For producing visible images, the toner should contain in the resinous binder a colorant which may be black or have a color of the visible spectrum, not excluding, however, the presence of mixtures of colorants to produce black or a particular color.

In the preparation of colored toner particles a resin blend as defined herein is mixed with said coloring matter which may be dispersed in said blend or dissolved therein forming a solid solution.

In black-and-white copying the colorant is usually an inorganic pigment, preferably carbon black, but may include, e.g., black iron (III) oxide. Inorganic colored pigments include, e.g., copper (II) oxide and chromium (III) oxide powder, milori blue, ultramarine cobalt blue and barium permanganate.

Examples of carbon black include lamp black, channel black and furnace black e.g., SPEZIALSCHWARZ IV (trade name of Degussa Frankfurt/M-Germany) and VULCAN XC 72 and CABOT REGAL 400 (trade names of Cabot Corp. High Street 125, Boston, U.S.A.).

In order to obtain toner particles having magnetic properties, a magnetic or magnetizable material in finely divided state is added during the toner production. Materials suitable for use include, e.g., magnetizable metals including iron, cobalt, nickel, and various magnetizable oxides, e.g., hematite ($Fe_2O_3$), magnetite ($Fe_3O_4$), $CrO_2$, and magnetic ferrites, e.g., those derived from zinc, cadmium, barium and manganese. Likewise various magnetic alloys, e.g. permalloys and alloys of cobalt-phosphors, cobalt-nickel and the like or mixtures of these may be used.

Toners for the production of color images may contain organic colorants that may include dyes soluble in the binder resin or pigments including mixtures thereof. Particularly useful organic colorants are selected from the group consisting of phthalocyanine dyes, quinacridone dyes, triaryl methane dyes, sulfur dyes, acridine dyes, azo dyes and fluoresceine dyes. A review of these dyes can be found in "Organic Chemistry" by Paul Karrer, Elsevier Publishing Company, Inc. New York, U.S.A. (1950). Dyestuffs described in the following published European patent applications may also be used: EP-0384040, EP-0393252, EP-0400706, EP-0384990, and EP-0394563.

In order to obtain toner particles with sufficient optical density in the spectral absorption region of the colorant, the colorant is preferably present therein in an amount of at least 1% by weight with respect to the total toner composition, more preferably in an amount of 3 to 20% by weight. The amount is selected in such a way as to obtain the specified optical density in the final image. In the case of dry toner particles, specific concentrations in the range of 2 to 8 wt. % are used.

Other fillers can be added to the toner composition to fine tune melt properties. For example, colloidal inorganic fillers such as colloidal silica, alumina, and/or titanium dioxide may be added in minor amounts. However, care should be taken as inorganic fillers may give rise to an undesired high melt viscosity, the need for higher fusing energies, and may inhibit a bright color.

In order to modify or improve the triboelectric chargeability in either a negative or a positive direction, the toner particles may contain one or more charge control agents. Such charge controlling agents may be present in an amount up to 8% by weight with respect to the toner particle composition.

In order to improve the flowability of the toner particles, spacing particles may be incorporated therein. Spacing particles are embedded in the surface of the toner particles or protrude therefrom. These flow improving additives are preferably extremely finely divided inorganic or organic materials, the primary (i.e., non-clustered) particle size of which is less than 50 nm. Widely used in this context are fumed inorganics of the metal oxide class, e.g., silica ($SiO_2$), alumina ($Al_2O_3$), zirconium oxide, and titanium dioxide, or mixed oxides thereof which have a hydrophilic or hydrophobic surface.

Apart from additives used to improve flow, conductivity regulating additives can also be used, e.g., tin dioxide particles in micron size, or use can be made of additives with an abrasive activity, e.g., $SrTiO_3$, in order to polish surfaces in contact with the toner material.

In addition to these metal oxides, a metal soap, e.g., zinc stearate, may be present in the toner particle composition in order to provide some lubricating activity.

The toner powder particles according to the preferred embodiments are prepared by mixing the above defined binder and ingredients in the melt phase, e.g., using a kneader. The kneaded mass preferably has a temperature in the range of 90 to 140° C. It is, however, preferred that said homogenization process is done at a temperature higher than the softening temperature and the melting temperature of the crystalline material, since both materials must be molten to a sufficient degree in order to achieve an intimate mixture. After cooling, the solidified mass is crushed, e.g., in a hammer mill, and the coarse particles obtained are further broken, e.g., by a jet mill, to obtain sufficiently small particles from which a desired fraction can be separated by sieving, wind sifting, cyclone separation, or other classifying techniques. The toner particles for actual use preferably have an average diameter between 3 and 20 $\mu$m, determined versus their average volume, more preferably between 5 and 10 $\mu$m when measured with a COULTER COUNTER (registered trade mark) Model Multisizer, operating according to the principles of electrolytic displacement in narrow aperture and marketed by COULTER ELECTRONICS Corp. Northwell Drive, Luton, Bedfordshire, LC 33, UK. In such an apparatus, particles suspended in an electrolyte (e.g., aqueous sodium chloride) are forced through a small aperture across which an electric current path has been established. The particles passing one-by-one each displace electrolyte in the aperture, producing a pulse equal to the displaced volume of electrolyte. Thus, particle volume response is the basis for said measurement. The average diameter (size) of the toner particles derived from their average volume or weight is given by the instrument (see also ASTM Designation: F 577-83).

Suitable milling and air classification may be obtained when employing a combination apparatus such as the Alpine Fliessbeth-Gegenstrahlmühle (A.G.F.) type 100 as milling apparatus and the Alpine Turboplex Windsichter (A.T.P.) type 50 G.C. as air classification apparatus, available from Alpine Process Technology, Ltd., Rivington Road, Whitehouse, Industrial Estate, Runcom, Cheshire, UK. Another useful apparatus for said purpose is the Alpine Multiplex Zick-Zack Sichter also available from the last mentioned company.

To the toner mass thus obtained a flow improving agent is added in a high speed stirrer, e.g. HENSCHEL FM4 of Thyssen Henschel, 3500 Kassel Germany.

The toner particles according to the preferred embodiments can also be rounded, e.g., by hot air treatment, in order to improve the powder flow properties. This is especially advantageous when small toner particles, i.e., smaller than 6 $\mu$m, are used. Also, a core/shell architecture can be envisaged for the toner particle, wherein the core of the toner particle can be a blend of amorphous and crystallite containing resins according to the preferred embodiments.

The powder toner particles according to the preferred embodiments may be used as mono-component developer, i.e., in the absence of carrier particles, but are preferably used in a two-component system comprising carrier particles.

When used in admixture with carrier particles, 2 to 10% by weight of toner particles is present in the whole developer composition. Proper mixing with the carrier particles may be obtained in a tumble mixer.

Suitable carrier particles for use in cascade or magnetic brush development are described, e.g., in United Kingdom Patent Specification 1,438,110. For magnetic brush development, the carrier particles may be based on ferromagnetic material, e.g., steel, nickel, iron beads, ferrites and the like, or mixtures thereof. The ferromagnetic particles may be coated with a resinous envelope or are present in a resin binder mass as described e.g. in U.S. Pat. No. 4,600,675. The average particle size of the carrier particles is preferably in the range of 20 to 300 $\mu$m and more preferably in the range of 30 to 100 $\mu$m.

The preferred embodiments are illustrated by the following non-limiting examples. All ratios, percentages and parts mentioned therein are by weight unless stated otherwise.

EXAMPLES

Example 1

The following toner preparation was conducted: 97 parts of CP1 were melt blended for 30 min at 95° C. in a laboratory kneader with 3 parts of a Cu-phthalocyanine pigment. After cooling, the solidified mass was pulverized and milled using an Alpine Fliessbettgegenstrahlmuhle type 100AFG™. The average particle diameter was measured with a Coulter Counter model Multisizer and was found to be 8.5 $\mu$m by volume. These toner particles were applied to a single side coated paper of 100 g/m$^2$ in an amount of 2.0 mg/cm$^2$.

Example 2

Example 1 was repeated, but instead of using 97 parts of CP1, a mixture of 48 parts of resin AP1 and 49 parts of CP1 was melt blended for 30 min at 105° C. in a laboratory kneader with 3 parts of a Cu-phthalocyanine pigment. According to the compatibility test, CP1 and AP1 showed compatible behavior. After cooling, the solidified mass was pulverized and milled using an Alpine Fliessbettgegenstrahlmuhle type 100AFG™. The average particle diameter was measured with a Coulter Counter model Multisizer and was found to be 7.35 $\mu$m by volume. Samples for fixing were made in a similar way as in Example 1.

Example 3

Example 2 was repeated, however 74 parts of resin AP1 and 23 parts of CP1 were melt blended for 30 min at 110°

C. in a laboratory kneader together with 3 parts of a Cu-phthalocyanine pigment. According to the compatibility test CP1 and AP1 show compatible behavior. After cooling, the solidified mass was pulverized and milled using an Alpine Fliessbettgegenstrahlmuhle type 100AFG™. The average particle diameter was measured with a Coulter Counter model Multisizer and was found to be 8.9 μm by volume. Samples for fixing were made in a similar way as in Example 1.

Example 4

Example 2 was repeated, however 88 parts of resin AP1 and 9 parts of CP1 were melt blended for 30 min at 110° C. in a laboratory kneader together with 3 parts of a Cu-phthalocyanine pigment. According to the compatibility test CP1 and AP1 showed compatible behavior. After cooling, the solidified mass was pulverized and milled using an Alpine Fliessbettgegenstrahlmuhle type 100AFG™. The average particle diameter was measured with a Coulter Counter model Multisizer and was found to be 9 μm by volume. Samples for fixing were made in a similar way as in Example 1.

Example 5

Example 2 was repeated, however 92 parts of resin AP1 and 5 parts of CP1 were melt blended for 30 min at 110° C. in a laboratory kneader together with 3 parts of a Cu-phthalocyanine pigment. According to the compatibility test CP1 and AP1 showed compatible behavior. After cooling, the solidified mass was pulverized and milled using an Alpine Fliessbettgegenstrahlmuhle type 100AFG™. The average particle diameter was measured with a Coulter Counter model Multisizer and was found to be 8.6 μm by volume. Samples for fixing were made in a similar way as in Example 1.

Example 6

Example 1 was repeated, however resin CP2 was used instead of CP1 and melt blended with 3 parts Cu-phthalocyanine pigment for 30 minutes at 105° C. in a laboratory kneader. After cooling, the solidified mass was pulverized and milled using an Alpine Fliessbettgegenstrahlmuhle type 100AFG™. The average particle diameter was measured with a Coulter Counter model Multisizer and was found to be 8.45 μm by volume. Samples for fixing were made in a similar way as in Example 1.

Example 7

Example 2 was repeated, however 48 parts of resin AP1 and 49 parts of CP2 were melt blended for 30 min at 110° C. in a laboratory kneader with 3 parts of a Cu-phthalocyanine pigment. According to the compatibility test CP2 and AP1 show compatible behavior. After cooling, the solidified mass was pulverized and milled using an Alpine Fliessbettgegenstrahlmuhle type 100AFG™. The average particle diameter was measured with a Coulter Counter model Multisizer and was found to be 8.76 μm by volume. Samples for fixing were made in a similar way as in Example 1.

Example 8

Example 2 was repeated, however 48 parts of resin AP1 and 49 parts of CP4 were melt blended for 30 min at 115° C. in a laboratory kneader with 3 parts of a Cu-phthalocyanine pigment. According to the compatibility test CP4 and AP1 show limited to no compatible behavior. After cooling, the solidified mass was pulverized and milled using an Alpine Fliessbettgegenstrahlmuhle type 100AFG™. The average particle diameter was measured with a Coulter Counter model Multisizer and was found to be 8.12 μm by volume. Samples for fixing were made in a similar way as in Example 1.

Example 9

Example 1 was repeated, however CP4 was used instead of CP1 and melt blended for 30 min at 120° C. in a laboratory kneader with 3 parts of a Cu-phthalocyanine pigment. After cooling, the solidified mass was pulverized and milled using an Alpine Fliessbettgegenstrahlmuhle type 100AFG™. The average particle diameter was measured with a Coulter Counter model Multisizer and was found to be 8.36 μm by volume. Samples for fixing were made in a similar way as in Example 1.

Example 10

Example 1 was repeated, however AP1 was used instead of CP1 and melt blended for 30 min at 120° C. in a laboratory kneader with 3 parts of a Cu-phthalocyanine pigment. After cooling, the solidified mass was pulverized and milled using an Alpine Fliessbettgegenstrahlmuhle type 100AFG™. The average particle diameter was measured with a Coulter Counter model Multisizer and was found to be 8.31 μm by volume. Samples for fixing were made in a similar way as in Example 1.

Example 11

Example 2 was repeated, however 48 parts of resin AP1 and 49 parts of CP3 were melt blended for 30 min at 120° C. in a laboratory kneader with 3 wt. % of a Cu-phthalocyanine pigment. According to the compatibility test CP3 and AP1 show no compatible behavior. After cooling a highly heterogeneous mixture was obtained and no further toner preparation was possible. No samples for fixing could be prepared.

The samples to be fixed were fused in the hot roller device as described above. Hot-roller fixing properties of the examples are reported in the Table 4. The samples are rated as follows: 1=excellent 3=acceptable 5=bad HO=hot offset (i.e., the image upon fusing shows some adherence to the fusing roller). Applied mass is 2.0 mg/cm$^2$. F-test is a folding test.

TABLE 4

| Example | Type | AP/CP | Ratio AP/CP | F-test 80° C. | F-test 100° C. | F-test 130° C. | Gloss 80° C. | Gloss 100° C. | Gloss 130° C. | WLF-test | Tack |
|---|---|---|---|---|---|---|---|---|---|---|---|
| 1 | comparative | CP1 | 100 | 1 | — | — | HO | — | — | 4 | 1 |
| 2 | pref. embodiment | AP1/CP1 | 50/50 | 1 | 1 | 1 | 2 | 2 | HO | 2 | 1 |
| 3 | pref. embodiment | AP1/CP1 | 75/25 | 1 | 1 | 1 | 1 | 1 | 1 | 1 | 3 |
| 4 | pref. embodiment | AP1/CP1 | 90/10 | 2 | 1 | 1 | 2 | 1 | HO | 1 | 3 |
| 5 | limit | AP1/CP1 | 92/5 | 3 | 1 | 1 | 3 | 1 | HO | 1 | 3–4 |
| 6 | comparative | CP2 | 100 | 2 | 1 | 1 | 4 | 3 | HO | 3 | 1 |
| 7 | pref. embodiment | AP1/CP2 | 50/50 | 1 | 1 | 1 | 2 | 1 | 2 | 1 | 2 |
| 8 | comparative | AP1/CP4 | 50/50 | 5 | 3 | 1 | 5 | 5 | HO | 2 | 2 |
| 9 | comparative | CP4 | 100 | 5 | 3 | 1 | 5 | 3 | HO | 3 | 1 |
| 10 | comparative | AP1 | 100 | 5 | 2 | 1 | 5 | 3 | HO | 1 | 5 |
| 11 | comparative | AP1/CP3 | 50/50 | — | — | — | — | — | — | — | — |

From the data it is observed that neither pure crystalline material, nor pure amorphous material, nor inhomogeneous blends of both give satisfactory results. The homogeneous blends of the preferred embodiments give satisfactory results.

Example 3 and 10 were repeated using non-contact fusing with an oven. Results are given in Table 5 and confirm the behavior of the contact fusing process. The behavior was rated as follows: 1=excellent 3=acceptable 5=bad. Applied mass was 2 mg/cm$^2$. A marked improvement of the fusing behavior for the blend is found compared to the pure amorphous material.

TABLE 5

| Example | Type | AP/CP | Ratio AP/CP | F-test 105° C. | F-test 115° C. | F-test 125° C. | Gloss 105° C. | Gloss 115° C. | Gloss 125° C. | WLF-test | Tack |
|---|---|---|---|---|---|---|---|---|---|---|---|
| 10 | comparative | AP1 | 100 | 3 | 3 | 2 | 3 | 1 | 1 | 1 | 5 |
| 3 | pref. embodiment | AP1/CP1 | 75/25 | 1 | 1 | 1 | 1 | 1 | 1 | 2 | 1 |

The above description discloses several methods and materials of the present invention. This invention is susceptible to modifications in the methods and materials, as well as alterations in the fabrication methods and equipment. Such modifications will become apparent to those skilled in the art from a consideration of this disclosure or practice of the invention disclosed herein. Consequently, it is not intended that this invention be limited to the specific embodiments disclosed herein, but that it cover all modifications and alternatives coming within the true scope and spirit of the invention as embodied in the attached claims. All patents, applications, and other references cited herein are hereby incorporated by reference in their entirety.

What is claimed is:

1. A dry toner composition, the composition comprising:

a colorant; and a binder resin, the binder resin comprising a physical mixture of an amorphous polymer and a crystalline phase-containing polymer, wherein the amorphous polymer and the crystalline phase-containing polymer are compatible in a molten state mixture and show no significant phase separation upon cooling of the molten state mixture, wherein the dry toner composition comprises from about 8 wt. % to about 55 wt. % of the crystalline phase-containing polymer, wherein the crystalline phase-containing polymer has a melt energy greater than or equal to about 35 J/g, and wherein the amorphous polymer has a Tg greater than or equal to about 35° C.

2. The dry toner composition of claim 1, wherein a melting point of the crystalline-phase containing polymer is greater than or equal to about 50° C.

3. The dry toner composition of claim 1, wherein a melting point of the crystalline-phase containing polymer is greater than or equal to about 65° C.

4. The dry toner composition of claim 1, wherein the Tg of the amorphous polymer is greater than or equal to 40° C.

5. The dry toner composition of claim 1, wherein a softening temperature of the binding resin is greater than or equal to 100° C.

6. The dry toner composition of claim 1, wherein the crystalline phase-containing polymer comprises a polyester.

7. The dry toner composition of claim 1, wherein the amorphous polymer comprises a polyester.

8. The dry toner composition of claim 1, wherein the amorphous polymer comprises a mixture of a polyester and a non-polyester.

9. The dry toner composition of claim 1, wherein the colorant comprises an inorganic pigment.

10. The dry toner composition of claim 1, wherein the colorant comprises an organic colorant.

11. The dry toner composition of claim 1, further comprising a colloidal inorganic filler.

12. The dry toner composition of claim 1, further comprising a charge control agent.

13. The dry toner composition of claim 1, further comprising spacing particles.

14. The dry toner composition of claim 1, further comprising a conductivity regulating agent.

15. The dry toner composition of claim 1, further comprising a metal soap.

16. The dry toner composition of claim 1, wherein the toner composition comprises particles, and wherein a particle size of the particles is from about 3 $\mu$m to about 20 $\mu$m in diameter.

17. The dry toner composition of claim 16, wherein the particles are rounded.

18. A developer composition, the composition comprising:

carrier particles; and a dry toner composition, the dry toner composition comprising:

a colorant; and a binder resin, the binder resin comprising a physical mixture of an amorphous polymer and a crystalline phase-containing polymer, wherein the amorphous polymer and the crystalline phase-containing polymer are compatible in a molten state mixture and show no significant phase separation upon cooling of the molten state mixture, wherein the dry toner composition comprises from about 8 wt. % to about 55 wt. % of the crystalline phase-containing polymer, wherein the crystalline phase-containing polymer has a melt energy greater than or equal to about 35 J/g, and wherein the amorphous polymer has a Tg greater than or equal to about 35° C.

19. The developer composition of claim 18, wherein a particle size of the carrier particles is from about 30 $\mu$m to about 100 $\mu$m in diameter.

20. A method for fusing a dry toner powder to a substrate, the method comprising:

applying a dry toner powder to a substrate, the dry toner powder comprising a colorant and a binder resin, the binder resin comprising a physical mixture of an amorphous polymer and a crystalline phase-containing polymer, wherein the amorphous polymer and the crystalline phase-containing polymer are compatible in a molten state mixture and show no significant phase separation upon cooling of the molten state mixture, wherein the dry toner composition comprises from about 8 wt. % to about 55 wt. % of the crystalline phase-containing polymer, wherein the crystalline phase-containing polymer has a melt energy greater than or equal to about 35 J/g, and wherein the amorphous polymer has a Tg greater than or equal to about 35° C.; and applying heat to the dry toner powder, whereby the dry toner powder is fused to the substrate, thereby forming an image.

21. The method of claim 20, wherein the image comprises a color image.

22. The method of claim 20, wherein the step of applying heat to the dry toner powder is conducted at a fusing speed greater than or equal to about 10 cm/sec.

23. The method of claim 20, further comprising the step of applying mechanical pressure to the dry toner powder, wherein the step of applying mechanical pressure to the dry toner powder is conducted simultaneously with the step of applying heat to the dry toner powder.

24. The method of claim 20, wherein the step of applying heat to the dry toner powder is contactless.

* * * * *